US006474736B1

(12) United States Patent
Brown

(10) Patent No.: US 6,474,736 B1
(45) Date of Patent: Nov. 5, 2002

(54) CONVERTIBLE CHILD'S PLAY SWING

(75) Inventor: Barrett W. Brown, Rockport, ME (US)

(73) Assignee: Cedarworks, Inc., Rockport, ME (US)

( * ) Notice: Subject to any disclaimer, the term of this patent is extended or adjusted under 35 U.S.C. 154(b) by 0 days.

(21) Appl. No.: 09/845,474

(22) Filed: Apr. 30, 2001

(51) Int. Cl.[7] ..... A47D 13/10
(52) U.S. Cl. ..... 297/280; 297/452.57; 297/274
(58) Field of Search ..... 297/280, 273, 297/274, 277, 284.1, 284.2, 284.11, 452.58, 452.57, 452.12; 5/120, 122, 98.3

(56) References Cited

U.S. PATENT DOCUMENTS

| | | | | | |
|---|---|---|---|---|---|
| 946,225 | A | * | 1/1910 | Irwin | |
| 1,265,126 | A | * | 5/1918 | Silver | |
| 1,569,045 | A | * | 1/1926 | Sommer | |
| 1,706,762 | A | * | 3/1929 | Wihebrink | |
| 2,317,243 | A | * | 4/1943 | Anderegg | 297/280 |
| 2,465,441 | A | * | 3/1949 | Ford | |
| 3,301,591 | A | * | 1/1967 | Jacobs | 297/219 |
| 4,752,982 | A | | 6/1988 | Jones et al. | |
| 4,819,286 | A | | 4/1989 | Beauchamp | |
| 5,088,747 | A | | 2/1992 | Morrison et al. | |
| 5,170,520 | A | * | 12/1992 | Milliken | 5/98.3 |
| 5,307,526 | A | | 5/1994 | Appleby | |
| 5,426,801 | A | | 6/1995 | Klearman et al. | |
| 5,947,552 | A | | 9/1999 | Wilkins et al. | |
| 5,987,665 | A | * | 11/1999 | Simantob et al. | 5/98.3 |
| 6,022,073 | A | * | 2/2000 | Yates | 297/284.1 X |
| 6,082,824 | A | | 7/2000 | Chow | |

* cited by examiner

*Primary Examiner*—Peter M. Cuomo
*Assistant Examiner*—Stephen Vu
(74) *Attorney, Agent, or Firm*—Fish & Richardson P.C.

(57) ABSTRACT

A child's play swing has a seat with a base panel defining a seating surface, side panels joined to the base panel along its side edges, and a back panel joined to the base panel along its back edge, together defining a swing volume for receiving and supporting a child during swinging. The base panel defines a pocket, and the swing includes a seating surface stiffener sized for removable placement within the pocket. In a first condition, with the seating surface stiffener removed from the pocket, the seat has are a relatively more pliable seating surface that forms about the body surface of a child placed within the swing volume, as suited for an infant unable to sit up on its own. In a second condition, with the seating surface stiffener installed within the pocket, the seat has a relatively more stiff seating surface that supports the body surface of a child placed within the swing volume without deflection, as suited for a toddler able to sit up on its own.

12 Claims, 2 Drawing Sheets

CONVERTIBLE CHILD'S PLAY SWING

TECHNICAL FIELD

This invention relates to play swings, and more particularly to play swings suitable for younger children, e.g. about 3 months to 3 years old.

BACKGROUND

Play swings suitable for younger children, e.g. those about 3 months to 3 years old, typically define a volume into which the child can be received and safely supported. Often, swings of this nature include a base or seat panel surrounded on three sides by side and back panels, with a vertical strap and crossbar at the front defining leg openings. As a child matures and becomes increasing more capable of supporting itself in a sitting position, the structural requirements of a play swing change.

SUMMARY

According to the invention, a child's play swing comprises a seat comprising a base panel, a first side panel joined to the base panel along a first side edge thereof, an opposite second side panel joined to the base panel along an opposite, second side edge thereof, a back panel joined to the base panel along a back edge thereof, joined to the first side panel along a back edge thereof, and joined to the opposite, second side panel along a back edge thereof, the base panel, the first side panel, the opposite, second side panel, and the back panel together defining a swing volume for receiving and supporting a child during swinging, and the base panel defining a seating surface and the base panel defining a pocket, and a seating surface stiffener sized for removable placement within the pocket. The seat, in a first condition, with the seating surface stiffener removed from the pocket, has a relatively more pliable seating surface adapted to form about the body surface of a child placed within the swing volume, as suited for an infant unable to sit up on its own. The seat, in a second condition, with the seating surface stiffener installed within the pocket, has a relatively more stiff seating surface adapted to support the body surface of a child placed within the swing volume without deflection, as suited for a toddler able to sit up on its own.

Preferred embodiments of the invention may include one or more of the following additional features. The play swing with the seat in its first condition is suited for use by an infant about three to twelve months old. The play swing with the seat in its second condition is suited for use by an toddler about one to three years old. The seat further comprises a strap element extending from a front edge of the base element to define, with front edges of the first and second side panels, leg openings. The swing further comprises a crossbar element, preferably a wooden bar, and the strap element has upper end attached to the crossbar element at a front region of the swing volume. The seat further comprises a securement device, e.g., comprising opposed, cooperative elements of a hook-and-loop type fastening system, for releasable securement of the seating surface stiffener within the pocket. The child's play swing further comprises means for suspension of the seat from a support, e.g. ropes. Preferably, the means for suspension supports the seat from front upper comers of the first and second side panels and front upper comers of the back panel. Two or more of the base panel, the first and second side panels and the back panel are integrally formed.

The invention thus provides a child's play swing convertible between use by infants (3 to 12 months) and use by toddlers (1 to 3 years).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
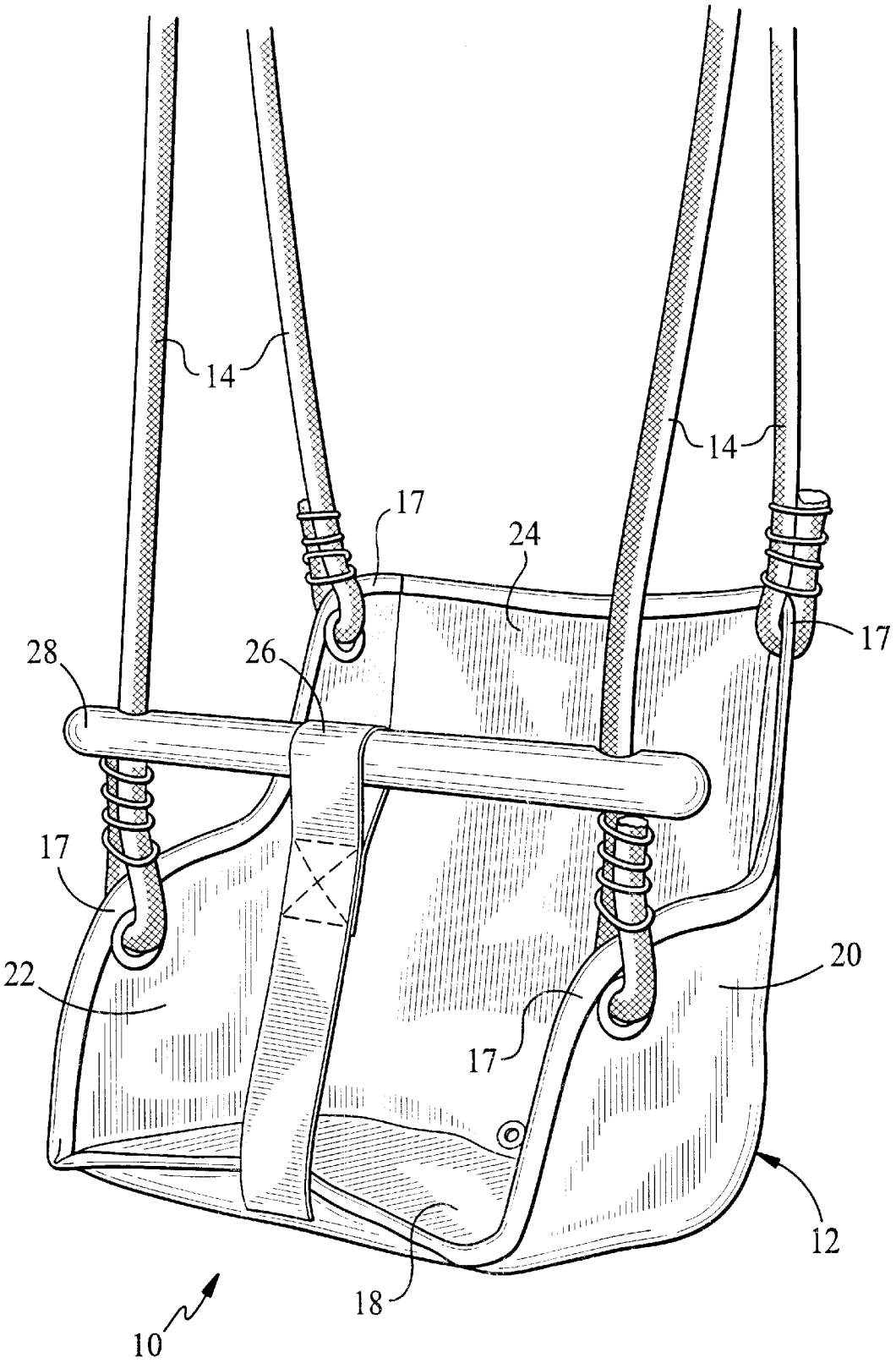
FIG. 1 is a perspective view of a convertible child's play swing of the invention.
Figure 3:
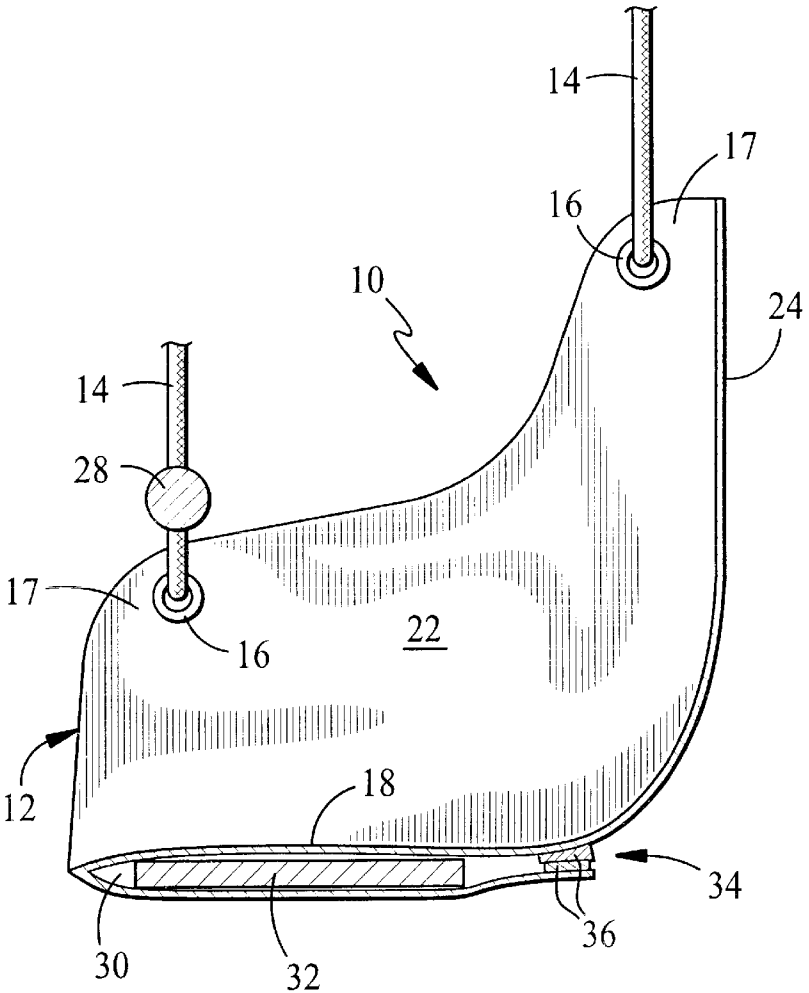
FIG. 3 is a similar side section view of the child's play swing of FIG. 1 in its second condition, suitable for use by a toddler, e.g. 1 to 3 years old.
Figure 2:
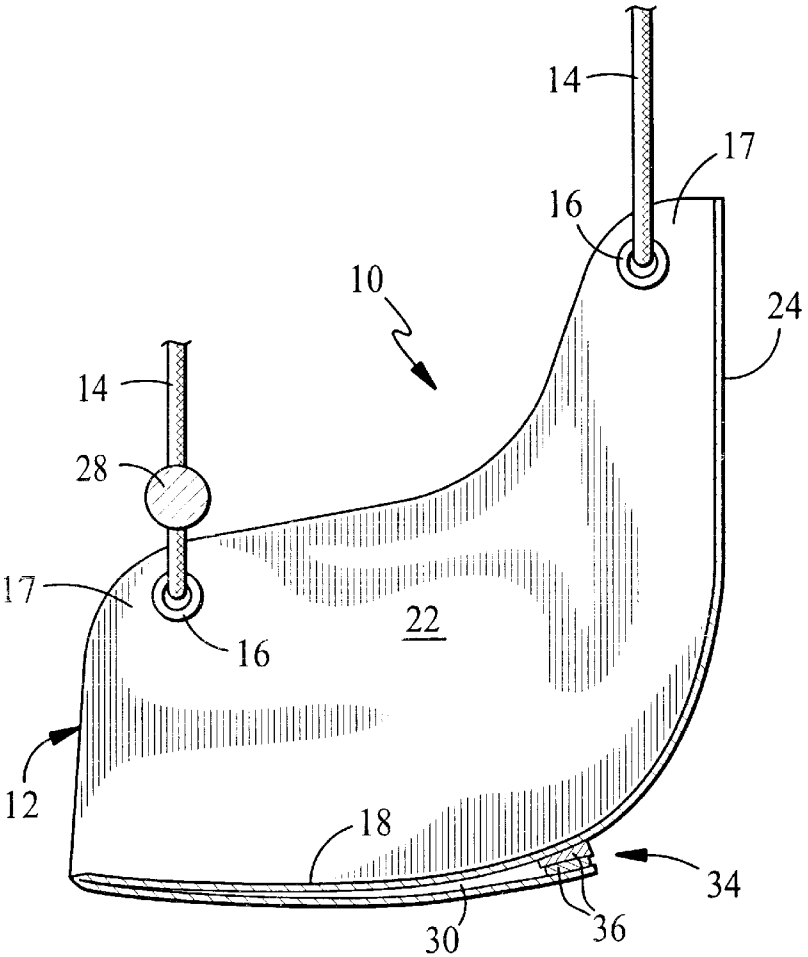
FIG. 2 is a side section view of the child's play swing of FIG. 1 in its first condition, suitable for use by an infant, e.g. 3 to 12 months old.

Referring to FIGS. 1–3, a child's play swing 10 of the invention consists of a seat 12 formed of flexible material, e.g., canvas, suspended by rope supports 14 attached through grommets 16 at each of four comers 17. In the preferred embodiment, the seat 12 is integrally formed of base 18, sides 20, 22, and a back panel 24 joined along adjacent edges, with a crotch strap 26 extending from the base 18 to a crossbar 28 for keeping a child placed therewithin from slipping out of the seat. Referring particularly to FIGS. 2 and 3, a pocket 30 formed beneath the seat base 18 receives stiff seat board 32, e.g. formed of wood, plastic or other suitable material, through an opening 34 at the rear. The opening is secured, e.g., by releasable, VELCRO®-type hook-and-loop fasteners 36.

According to the invention, in its first condition (FIG. 2), with the seat board 32 removed from pocket 30, the play swing seat 12 forms a relatively more pliable, form-fitting support suitable for a younger child or infant, e.g. 3 to 12 months old. In its second condition (FIG. 3), with the seat board 32 placed within the pocket 30, and secured in place by fasteners 36, the play swing seat 12 provides relatively more rigid support suitable for an older child or toddler, e.g., a toddler 1 to 3 years old, able to sit on its own.

A number of embodiments of the invention have been described. Nevertheless, it will be understood that various modifications may be made without departing from the spirit and scope of the invention. For example, the play swing 10 may be formed of any suitable material. The swing may also be suspended in any suitable fashion. Accordingly, other embodiments are within the scope of the following claims.

What is claimed is:

1. A child's play swing comprising:

a seat comprising a base panel, a first side panel joined to said base panel along a first side edge thereof, an opposite second side panel joined to said base panel along an opposite, second side edge thereof, a back panel joined to said base panel along a back edge thereof, joined to said first side panel along a back edge thereof, and joined to said opposite, second side panel along a back edge thereof, wherein said base panel, said first side panel, said opposite, second side panel, and said back panel together define a swing volume for receiving and supporting a child during swinging, and said base panel define a seating surface and a pocket, and a seating surface stiffener sized for removable placement within said pocket, the pocket including a fastener constructed to secure an edge portion of said pocket to a portion of the base panel by a fastener, to retain the seating surface stiffener within the pocket, the fastener being releasable to allow the edge portion to be detached from the base panel and the seating surface stiffener to be removed from the pocket, said seat, in a first condition, with said seating surface stiffener removed from said pocket, having a relatively more pliable seating surface adapted to form about the body surface of a child placed within said swing volume, as suited for an infant unable to sit up on its own, and said seat, in a second condition, with said seating surface stiffener installed within said pocket, having a relatively more stiff seating surface adapted to support the body surface of a child placed within said swing volume without deflection, as suited for a toddler able to sit up on its own.

2. The child's play swing of claim 1, wherein said seat, in said first condition, is suited for use by an infant about three to twelve months old.

3. The child's play swing of claim 1, wherein said seat, in said second condition, is suited for use by an toddler about one to three years old.

4. The child's play swing of claim 1, wherein said seat further comprises a strap element extending from a front edge of said base element to define, with front edges of said first and second side panels, leg openings.

5. The child's play swing of claim 4, wherein said swing further comprises a crossbar element, and said strap element has a upper end attached to said crossbar element at a front region of said swing volume.

6. The child's play swing of claim 5, wherein said crossbar element is a wooden bar.

7. The child's play swing of claim 1, wherein said seat further comprises a securement device for releasable securement of said seating surface stiffener within said pocket.

8. The child's play swing of claim 7, wherein said securement device comprises opposed, cooperative elements of a hook-and-loop type fastening system.

9. The child's play swing of claim 1, further comprising means for suspending said seat from a support.

10. The child's play swing of claim 9, wherein said means for suspending comprises ropes.

11. The child's play swing of claim 9, wherein said means for suspending supports said seat from front upper corners of said first and second side panels and front upper corners of said back panel.

12. The child's play swing of claim 1, wherein two or more of said base panel, said first and second side panels and said back panel are integrally formed.

* * * * *